US006227472B1

(12) United States Patent
Ryan et al.

(10) Patent No.: US 6,227,472 B1
(45) Date of Patent: May 8, 2001

(54) STONECRUSHER WITH EXTERNALLY ADJUSTABLE ANVIL RING

(76) Inventors: Robert Ryan; Joe Kizziah, both of 705 Moccasin Bend Rd., Chattanooga, TN (US) 37405

( * ) Notice: Subject to any disclaimer, the term of this patent is extended or adjusted under 35 U.S.C. 154(b) by 0 days.

(21) Appl. No.: 09/444,153

(22) Filed: Nov. 20, 1999

(51) Int. Cl.[7] ..... B02C 19/00
(52) U.S. Cl. ..... 241/275
(58) Field of Search ..... 241/275

(56) References Cited

U.S. PATENT DOCUMENTS 5,533,685 * 7/1996 Heck ..... 241/275
5,806,774 * 9/1998 Vis ..... 241/275
6,070,820 * 6/2000 Young et al. ..... 241/275

* cited by examiner

*Primary Examiner*—Mark Rosenbaum
(74) *Attorney, Agent, or Firm*—Michael I Kroll

(57) ABSTRACT

The present invention 10 discloses a device for crushing stone 12 having an externally adjustable anvil ring 22. The anvil ring 22 is contained within a drum 24 and has multiple lifts 26 mounted on hydraulic support members 32 which can be adjusted from a control panel 46 either manually 48 or automatically 50. The anvils 38 are spaced about the anvil zing 22 so that the faces 52 of the multiple anvils 38 are substantially perpendicular to the line of travel of the stones 12. The anvils 38 have anchors 64 for attachment to the anvil ring 22 whereby the worn anvils 38 can be easily inverted so as to prolong anvil life.

16 Claims, 9 Drawing Sheets

STONECRUSHER WITH EXTERNALLY ADJUSTABLE ANVIL RING

BACKGROUND OF THE INVENTION

1. Field of the Invention

The present invention relates generally to stonecrushers and, more specifically, to stonecrushers with an externally adjustable anvil ring that can be raised or lowered incrementally during operation to provide even wear on the anvils.

2. Description of the Prior Art

There are numerous stonecrushers which provide for the fragmentation of rocks. While these stonecrushers may be suitable for the purposes for which they where designed, they would not be as suitable for the purposes of the present invention as heretofore described. It is thus desirable to provide a stonecrusher with an externally adjustable anvil ring that can be raised or lowered during operation to provide for even disintegration of the anvils caused by the impact of the stones being crushed. It is further desirable to provide a stonecrusher that utilizes the material being pulverized to protect components of the apparatus from the impact of the hurtling stones.

SUMMARY OF THE PRESENT INVENTION

The present invention discloses a device for crushing stone having an externally adjustable anvil ring. The anvil ring is contained within a drum and has multiple lifts mounted on hydraulic support members which can be adjusted from a control panel either manually or automatically. The anvils are spaced about the anvil ring so that the face of the multiple anvils are perpendicular to the line of travel of the stones. The anvils have anchors for attachment to the anvil ring whereby the worn anvils can be easily inverted so as to prolong anvil life.

The present invention relates generally to stonecrushers and, more specifically, to a stonecrusher with an adjustable anvil ring which allows an operator to adjust the height of the anvil ring without having to disassemble the unit. This will permit the operator to make adjustments without shutting down operation.

A primary object of the present invention is to provide a stonecrusher with an externally adjustable anvil ring which will overcome the shortcomings of prior art devices.

Another object of the present invention is to provide a stonecrusher with an adjustable anvil ring that has anvils that are angled to directly receive the impact of the stones and increase the efficiency of the apparatus.

Another object of the present invention is to provide a stonecrusher with an adjustable anvil ring whereby the anvils are arranged to form a stepped cylinder with comers to accumulate stone fragments that will receive the impact of the shattering projectiles thereby reducing the wear of the anvil heads.

A still further object of the present invention is to provide a stonecrusher with an adjustable anvil ring that will contain a 90-degree lip at the end of each propulsion wall in the centrifugating head. Material will be forced against the lip and accumulate along the propulsion wall as the centrifugating head spins. The stone introduced into the head will then strike the accumulated material rather than wearing down the propulsion wall.

Another object of the present invention is to provide a stonecrusher with an adjustable anvil ring that can move the anvil ring at a pre-determined rate according to the amount of stone that has passed through or could be set by timer.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
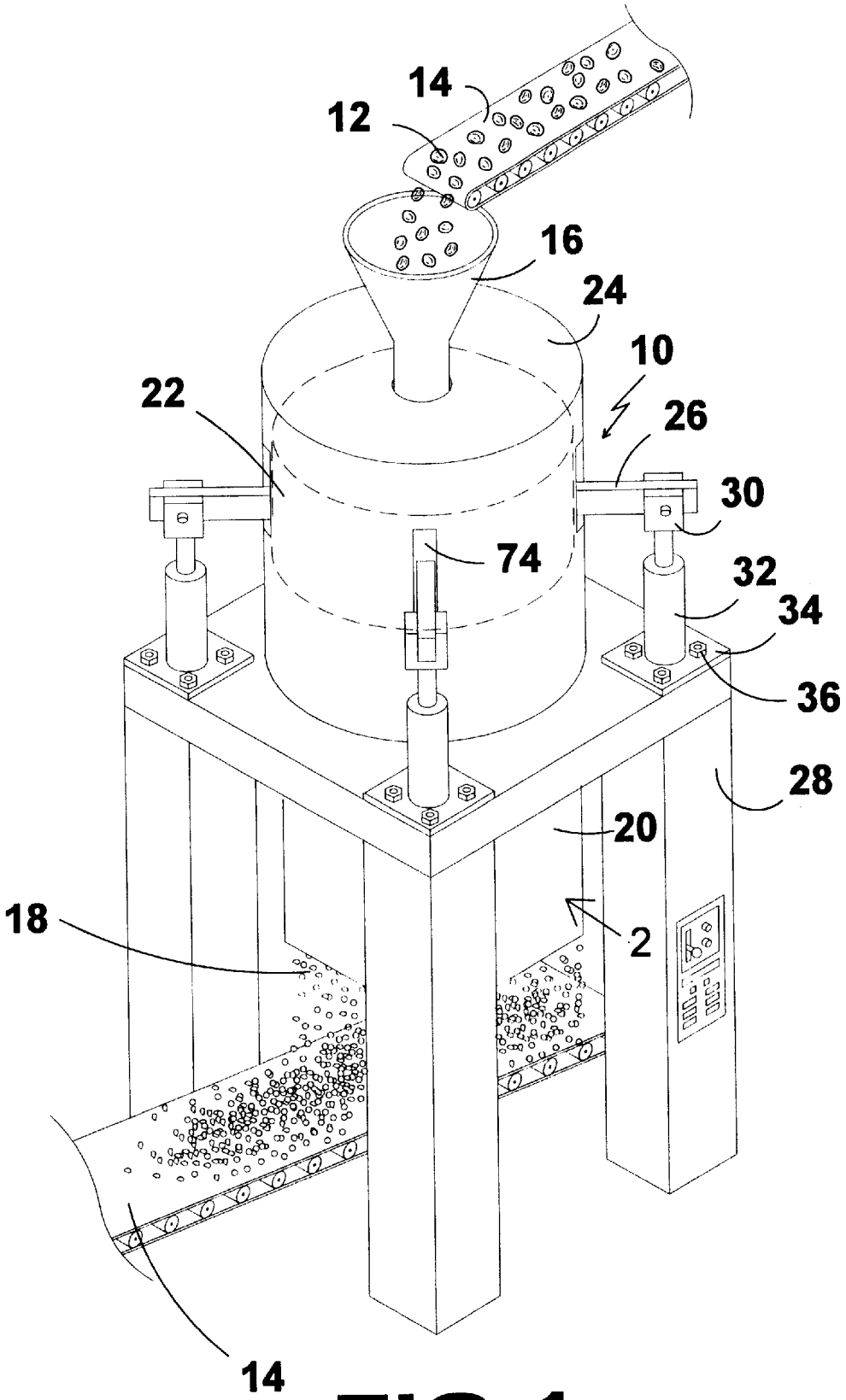
FIG. 1 is a perspective view of the present invention in use. Stone is being dropped through the feeder tube into the rotating centrifugating head. The centrifugating head then propels the stone against the anvils in the anvil ring where fragmentation occurs resulting in smaller stone which drops through the bottom egress. The anvil ring is shown in hidden line inside the drum. The operator can raise the ring via the hydraulic lifts on the base. This can be done during operation instead of shutting down and disassembling the unit as in the prior art.

With regard to reference numerals used, the following numbering is used throughout the drawings.

10 present invention
12 stone
14 conveyor belt
16 feeder tube
18 crushed stone
20 bottom egress
22 anvil ring
24 drum
26 lifts
28 base
30 means for attaching lifts
32 support members
34 support member base
36 means for connection
37 centrifugal head
38 anvil
40 drive shaft
42 smaller gear
44 larger gear
46 control panel
48 manual control
50 automatic control
52 anvil face
54 propulsion wall
56 direction arrow
58 retainer lip
60 material build up
61 following stone
62 corners of anvil
64 anvil anchor
66 anvil head
68 groove
70 power unit
72 cover for gear drive
74 apertures

DESCRIPTION OF THE PREFERRED EMBODIMENT(S)

In order that the invention may be more fully understood, it will now be described, by way of example, with reference to the accompanying drawings in which FIGS. 1 through 9 illustrate the present invention being a stone crusher with an externally adjustable anvil ring.

Turning to FIG. 1, shown therein 1 is a perspective view of the present invention 10 in use. Stone 12 is being dropped off conveyor belt 14 through the inlet feeder tube 16 into the rotating centrifugating head (not shown). The centrifugating head then propels the stone 12 against the anvils (not shown) in the anvil ring 22 where fragmentation occurs resulting in smaller crushed stone 18 which drops through the bottom outlet egress 20. The anvil ring 22 is shown in hidden line inside the drum 24. The operator can raise the ring 22 via the attached hydraulic lifts 26 attached to the base 28, which pass through apertures 74 in the wall of drum 24. This can be done during operation instead of shutting down and disassembling the unit as in the prior art. Rod-like lifts 26 have means 30 for connecting to vertically standing support members 32 which have a flanged base 34 having means 36 for connection to base 28. A second conveyor belt 14 carries the crushed stone 18 away.

Figure 2:
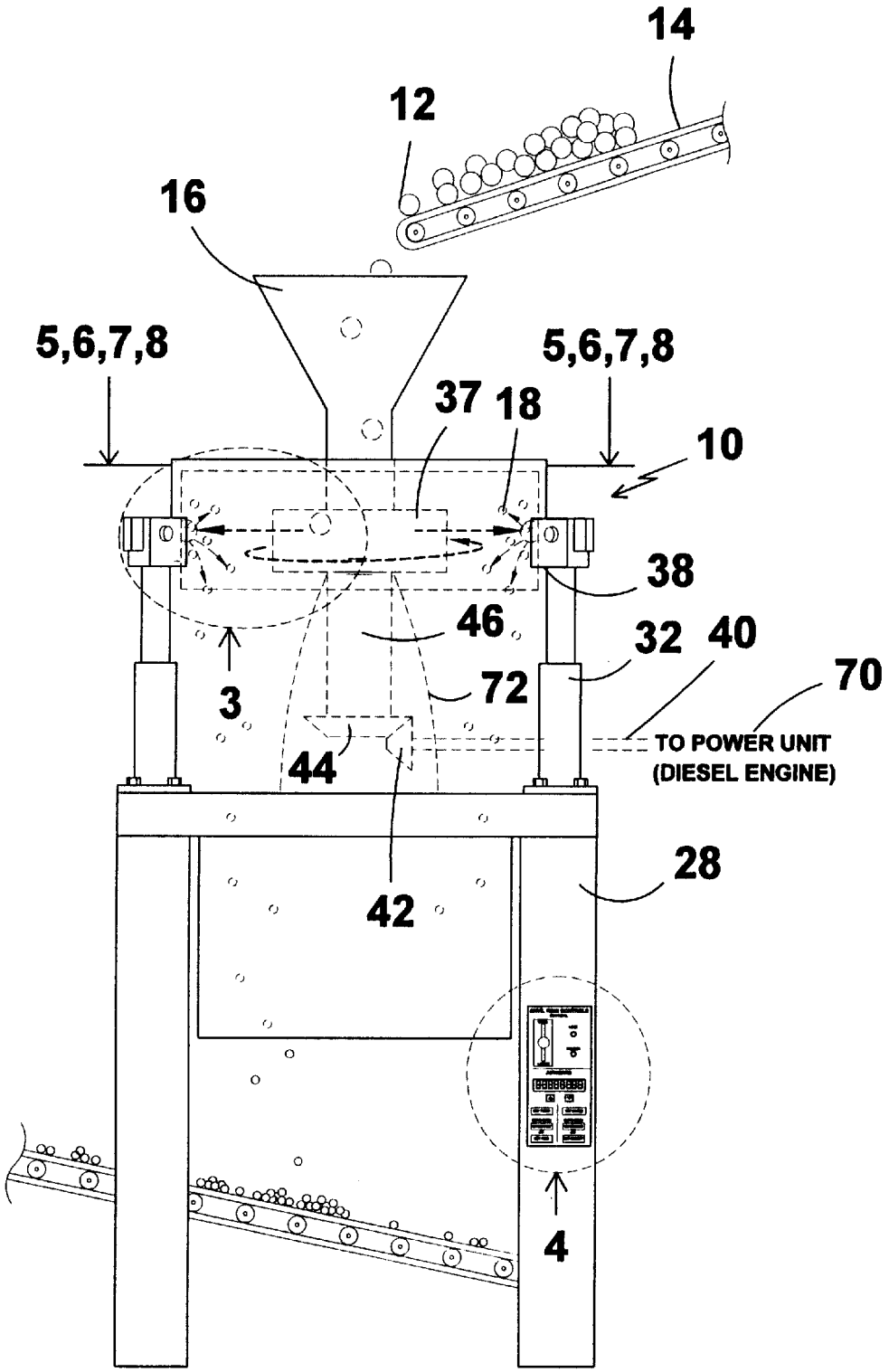
FIG. 2 is an illustrated view of the present invention in use, taken from FIG. 1 as indicated, showing the path of the stone passing through the feeder tube and getting propelled from the centrifugating head into the anvils and shattering into smaller pieces.

Turning to FIG. 2, shown therein is an illustrated view of the present invention 10 in use, taken from FIG. 1 as indicated, showing the path of the stone 12 passing through the feeder tube 16 and getting propelled from the below situated generally horizontal centrifugating head 37 into the anvils 38 and shattering upon impact into smaller pieces 18 which fall by gravity onto a lower conveyor belt. Also shown is a rotatable drive shaft 40 connected to a power unit 70, e.g., an internal combustion engine or diesel engine, having a smaller gear 42 connected to a larger gear 44 having a right angle orientation being a pair of bevel gears, said larger gear 44 driving a shaft 46 coupled to the head 37. Other features previously disclosed are also shown. Gear drives 42, 44 are protected by a cover 72.

Figure 3:
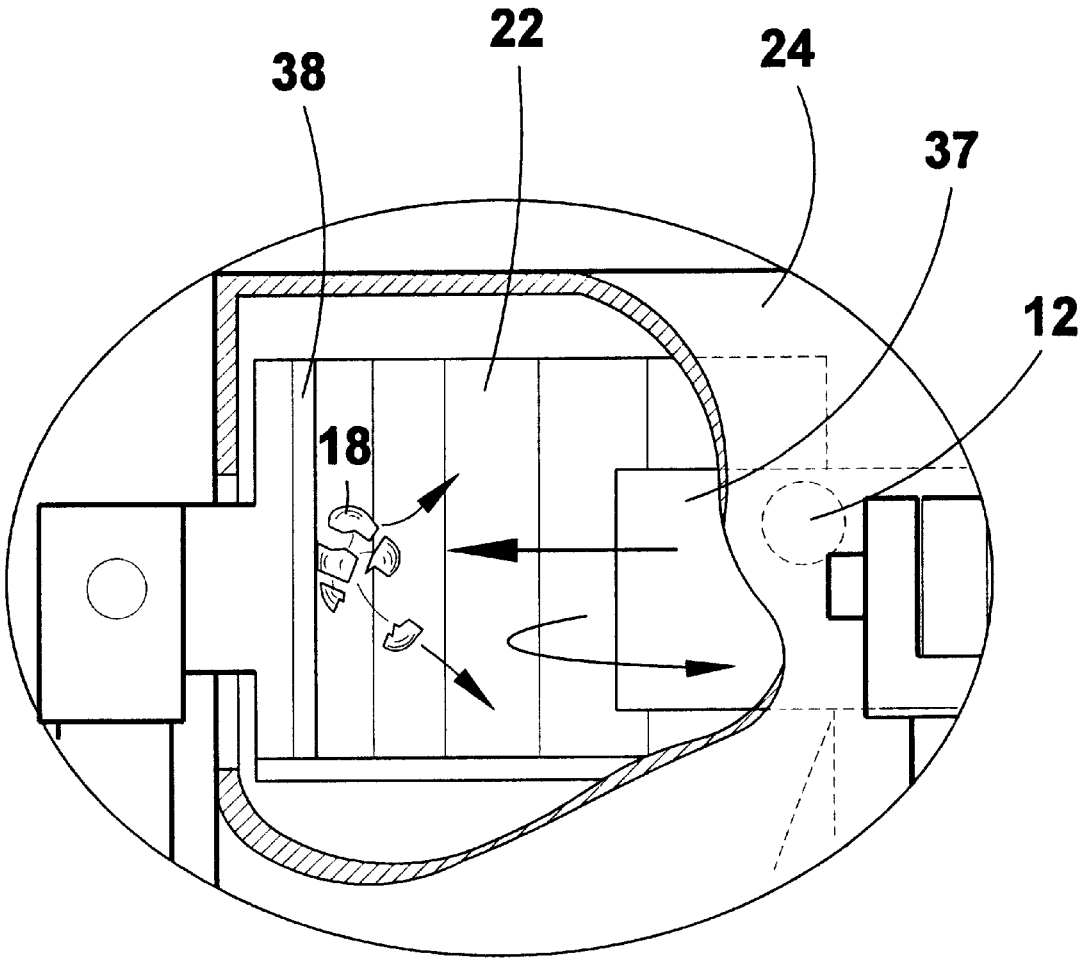
FIG. 3 is a detailed sectional view, taken from FIG. 2 as indicated, showing a stone being expelled from the centrifugating head and fragmenting upon impacting the anvil.

Turning to FIG. 3, shown therein is a detailed sectional view, taken from FIG. 2 as indicated, showing a stone 18 being expelled from the centifugating head 37 and fragmenting upon impacting the anvil 38. Other features previously disclosed are also shown.

Figure 4:
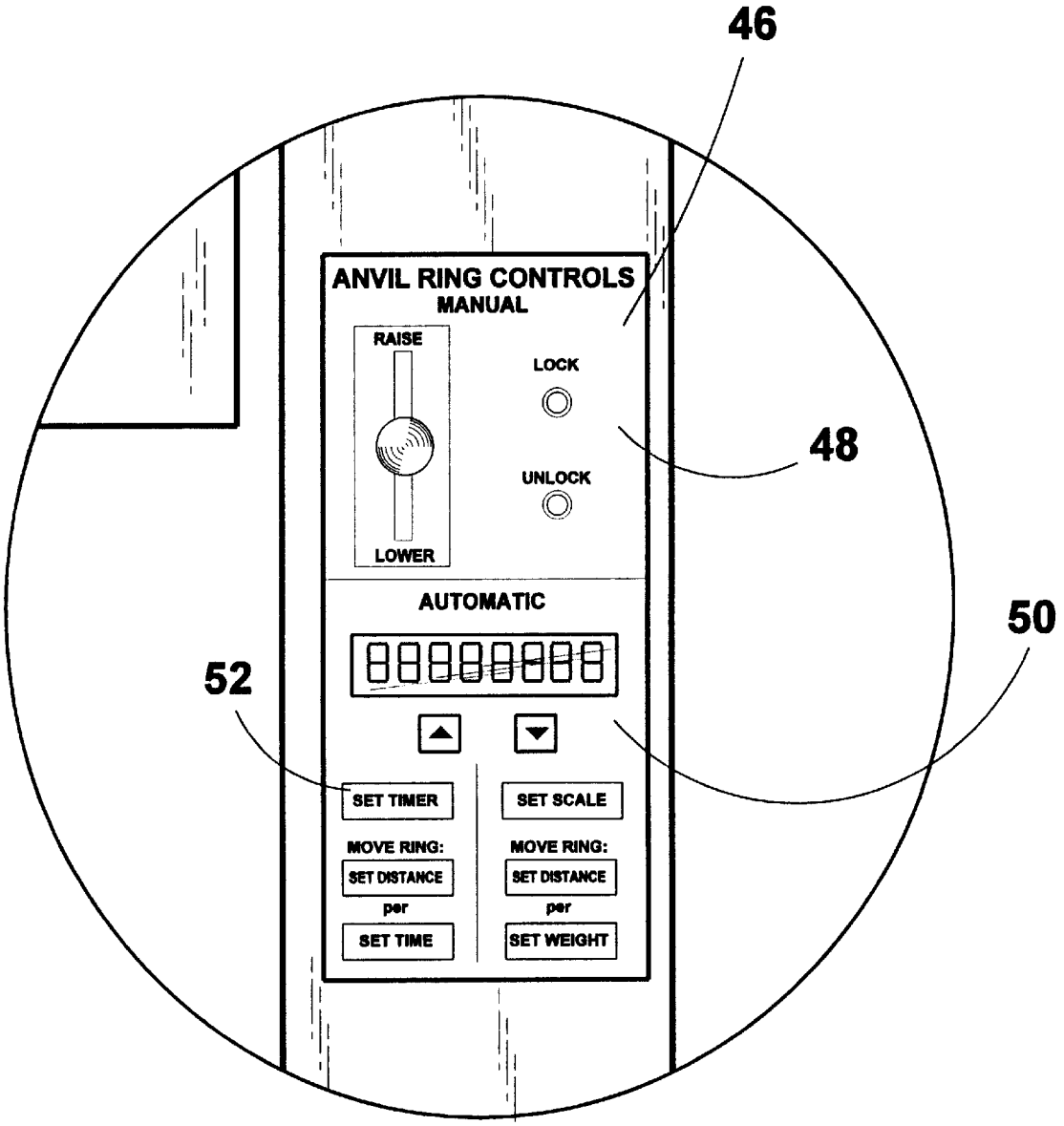
FIG. 4 is a detailed view, taken from FIG. 2 as indicated, showing the anvil ring control panel consisting of a manual control and an automatic control that can be preset to raise and/or lower the anvil at variable rates depending on a timer or the volume of stone processed.

Turning to FIG. 4, shown therein is a detailed view, taken from FIG. 2 as indicated, showing the anvil ring control panel 46 consisting of a manual control 48 and an automatic control 50 that can be preset to adjust the height or raise and/or lower the anvil 22 at variable rates depending on a timer 52 or the volume of stone processed.

Figure 5:
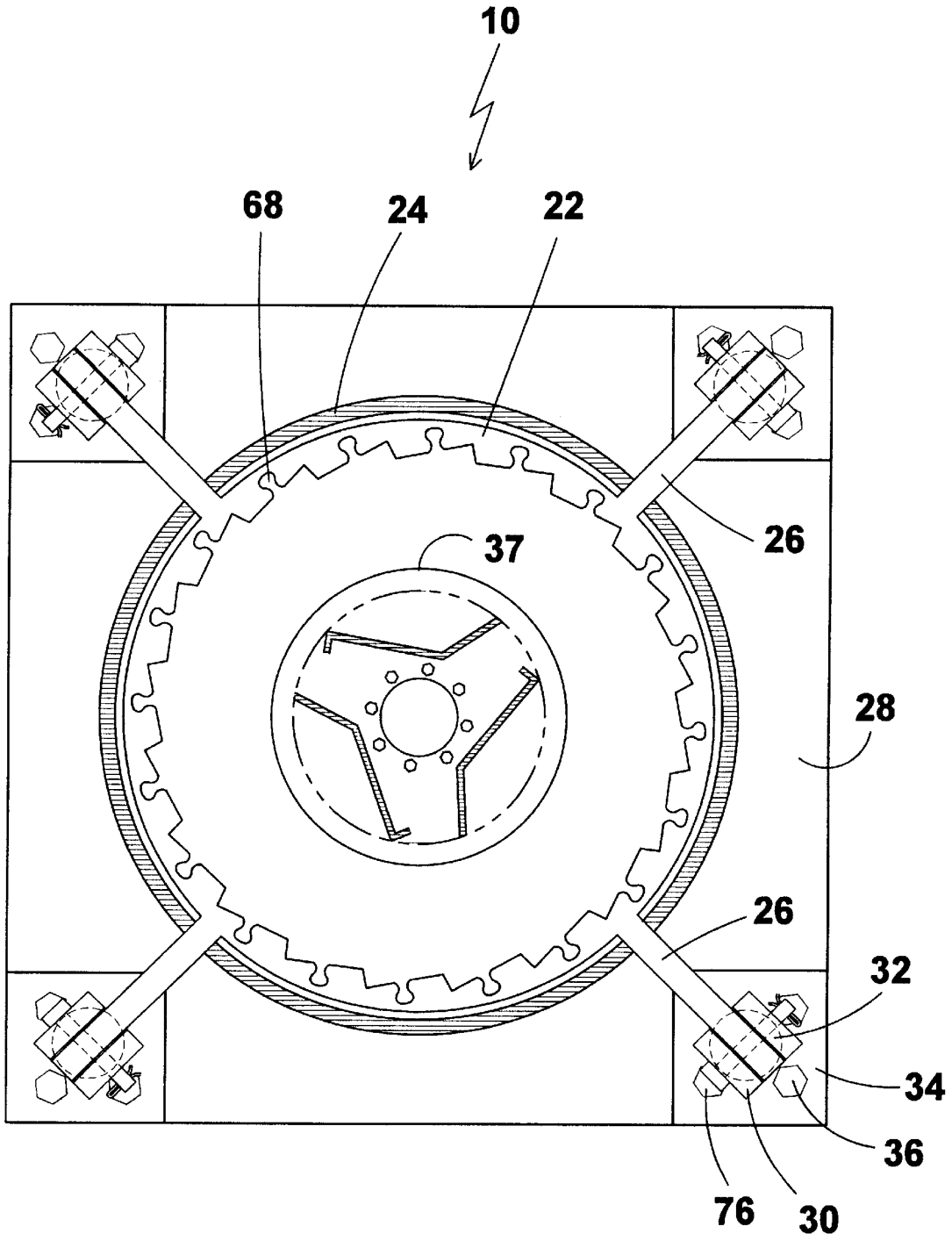
FIG. 5 is a sectional view of the present invention, taken from FIG. 2 as indicated, showing the anvil ring without the anvils installed, set into the interior of the drum with four lifter arms extending to an exterior portion of the drum and affixed to hydraulic jacks.

Turning to FIG. 5, shown therein is a sectional view of the present invention 10, taken from FIG. 2 as indicated, showing the anvil ring 22 with spaced apart receiving grooves 68 without the anvils installed, set into the interior of the drum 24 with four lifter arms 26 extending to an exterior periphery of the anvil ring 22 and affixed to hydraulic jacks or support members 32. Other features previously disclosed are also shown. Multiple fasteners 76 attach arm 26 to supports 32. Centifigal head 37 is also shown.

Figure 6:
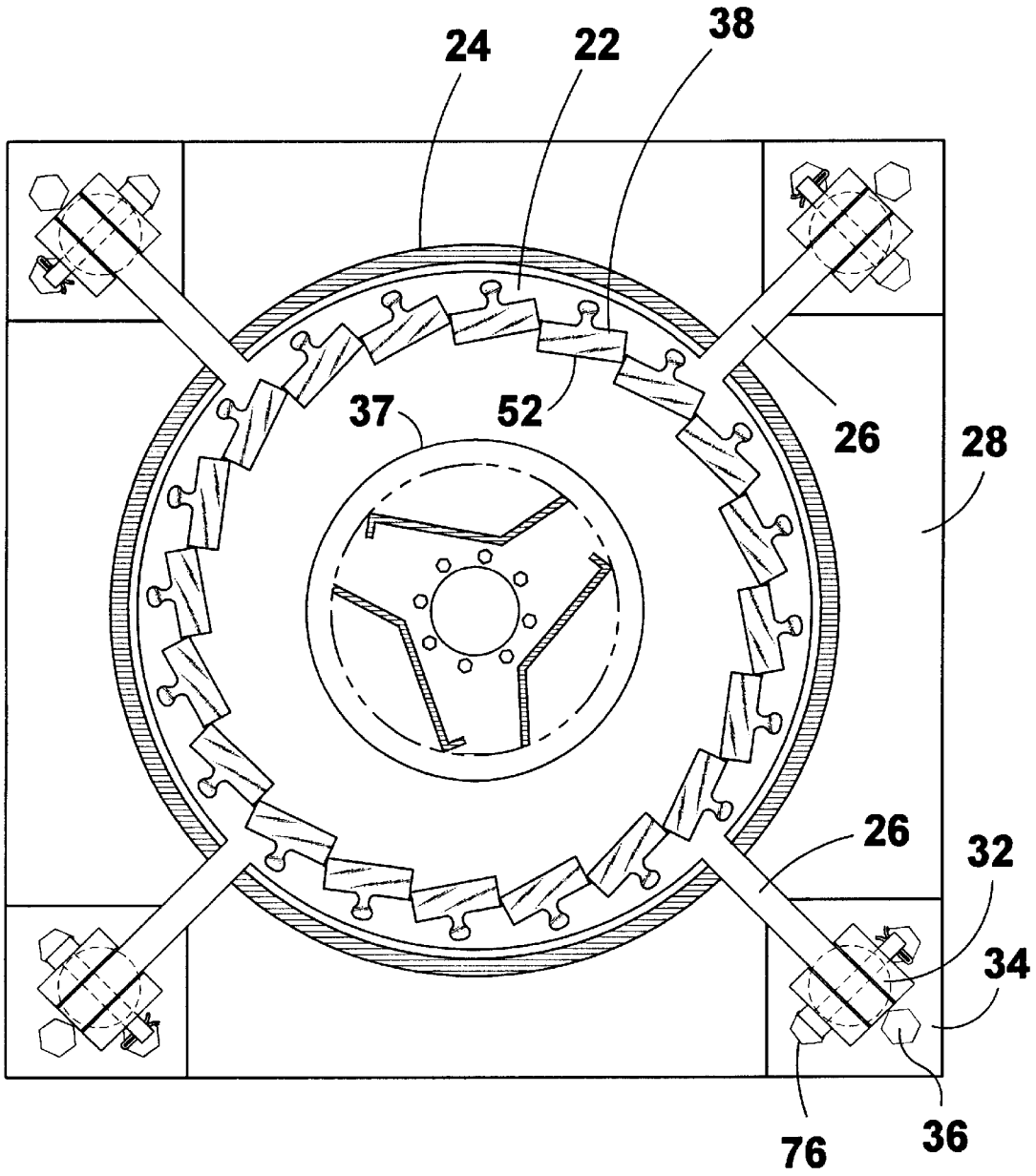
FIG. 6 is a cross sectional view of the present invention, taken from FIG. 2 as indicated, with all 20 anvils installed in the anvil ring. The anvil faces are situated at an angle that provides for the direct impact of the stone projectiles rather than the deflection characteristic of the centrally faced anvils found in the prior art.

Turning to FIG. 6, shown therein is a cross sectional view of the present invention 10, taken from FIG. 2 as indicated, with all approximately 20 anvils 38 installed in the anvil ring 22. The anvil faces 52 are situated at an angle that places the anvil face 52 substantially perpendicular to the line of travel of the stone projectiles rather than the deflection characteristic of the centrally faced anvils found in the prior art. Other features previously disclosed are also shown.

Figure 7:
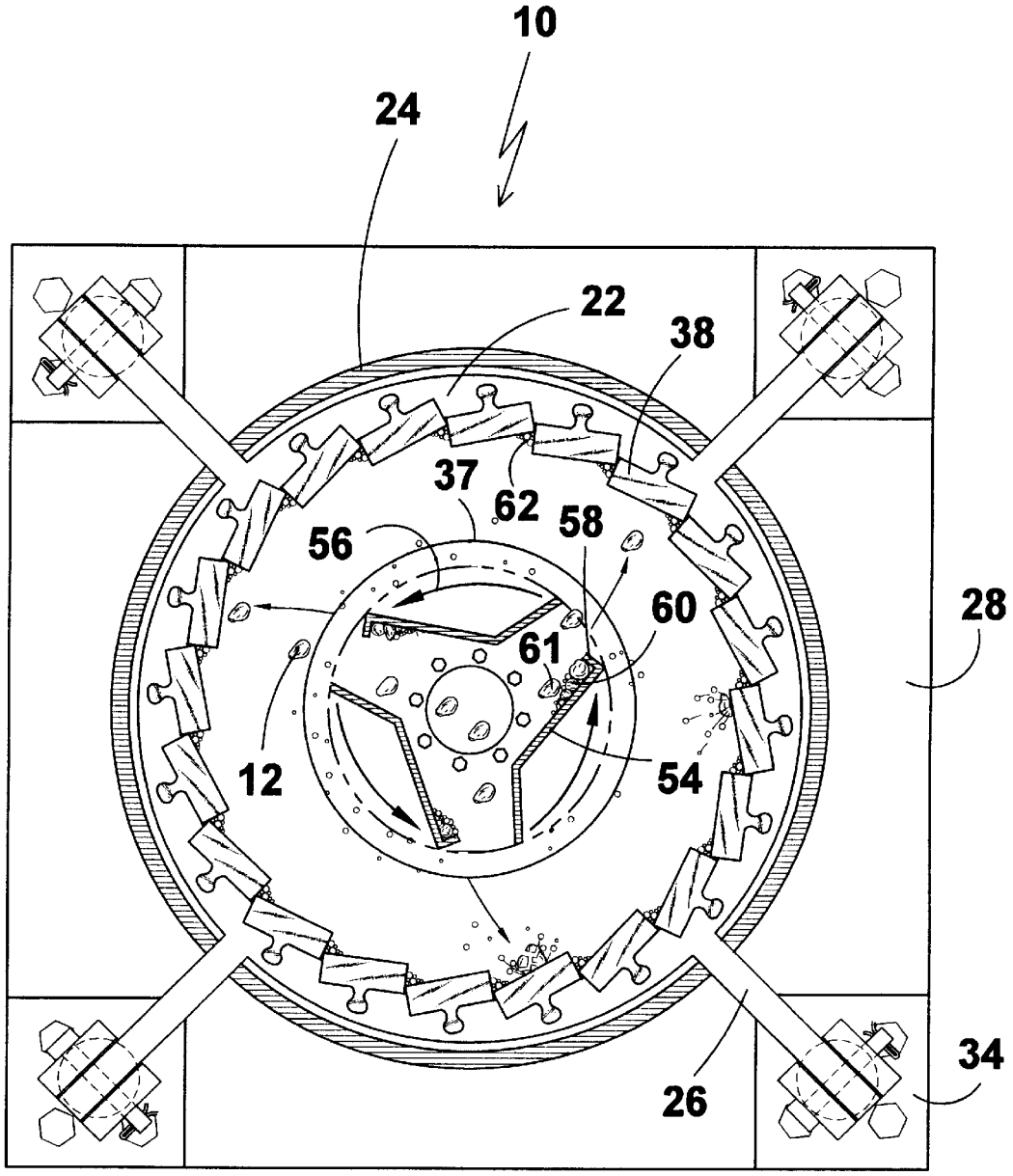
FIG. 7 is a cross sectional view of the present invention, taken from FIG. 2 as indicated, during the commencement of operation. The stone is dropped into the spinning centrifugating head where it is makes contact with one of the three propulsion walls. Centrifugal force then propels the stone along the propulsion wall until it is caught by a retainer lip at the end of the wall resulting in a build-up of material. The following stones will then roll over the accumulated material and be expelled toward the anvils with a force great enough to shatter the stones. For greater fragmentation of the stone being processed the operator would increase the rpm's of the centrifugating head. Some fragments will get jammed in the corners where the anvils meet resulting in an accumulation of material.

Turning to FIG. 7, shown therein is a cross sectional view of the present invention 10, taken from FIG. 2 as indicated, during the commencement of operation. The stone 12 is dropped into the spinning receiving means of the (see direction arrow 56) centrifugating head 37 where it makes contact with one of the specially configured three propulsion walls 54. Centrifugal force then propels the stone 12 along the propulsion wall 54 until it is caught by a retainer lip 58 at the end of the wall 54 resulting in a build-up of material 60. The following stones 61 will then roll over the accumulated material 60 and be expelled toward the anvils 38 with a force great enough to shatter the stone 61. For greater fragmentation of the stone being processed the operator would increase the rpm's of the centrifugating head 37. Some fragments will get jammed in the corners 62 where the anvils 38 meet resulting in an accumulation of material. Other features previously disclosed are also shown.

Figure 8:
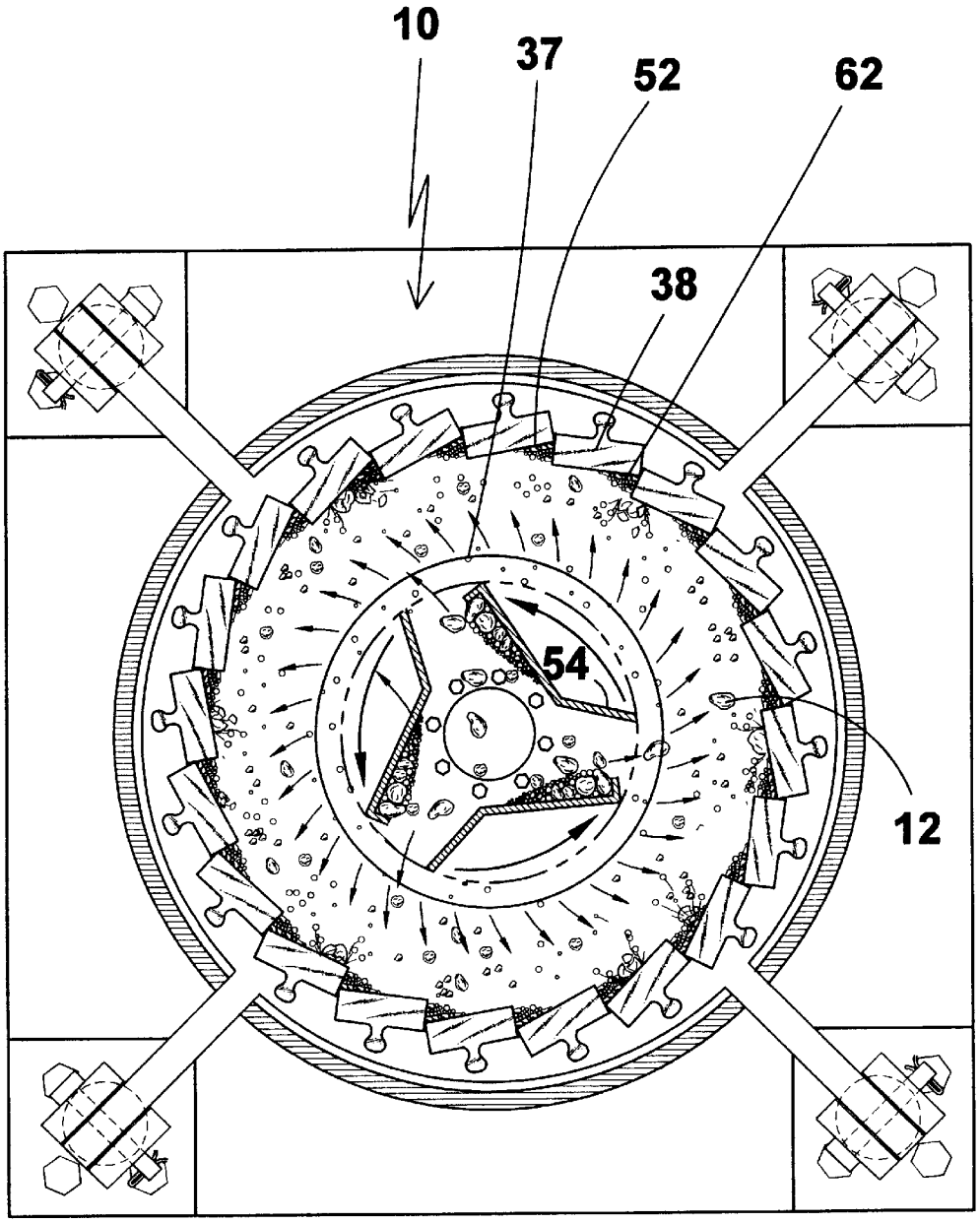
FIG. 8 is a cross sectional view of the present invention while fully operational. Material has accumulated on the propulsion wall in sufficient quantity to receive the impact of stones introduced into the centrifugal head before expelling them. Stone fragments have collected in the corners where the anvils meet partially covering the anvil heads to provide a surface for the stone projectiles to strike and thus reduce the wear on the anvils. Once the exposed anvil surface is thoroughly worm, the anvils can be removed and reinstalled in an inverted position thereby placing the worn section of the anvil face into a protected position.

Turning to FIG. 8, shown therein is a cross sectional view of the present invention 10 while fully operational. Material has accumulated on the propulsion wall 54 in sufficient quantity to receive the impact of stones 12 introduced into the centrifugal head 37 before expelling them. Stone fragments have collected in the corners 62 where the anvils 38 meet partially covering the anvil heads or faces 52 to provide a surface for the stone projectiles to strike and thus reduce the wear on the anvils 38. Once the exposed anvil surface 52 is thoroughly worn, the anvils 38 can be removed and reinstalled in an inverted position thereby placing the worn section of the anvil face 52 into a protected position. The present invention 10 is designed so that about one-half of the anvil face 52 is covered by stone in the corners 62 so as to reduce wear on the anvil face 52.

Figure 9:
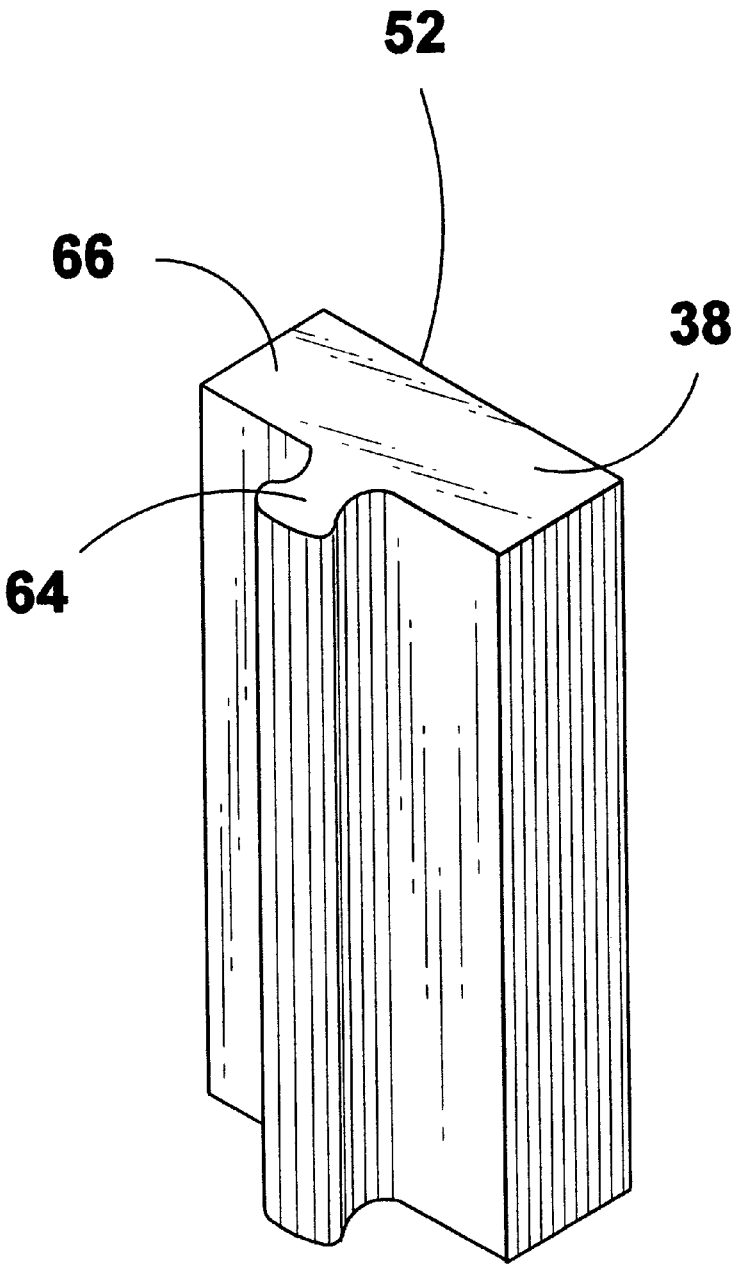
FIG. 9 is a perspective view of an anvil removed from the anvil ring. The anchor portion is protruding from the anvil head and slides into the receiving groove of the anvil ring to lock into place prior to operation. The anvil is asymmetrical to allow a worn anvil to be inverted thus reversing the wear pattern on the anvil face and prolong longevity of the anvil.

Turning to FIG. 9, shown therein is a perspective view of an anvil 38 removed from the anvil ring. The anchor portion 64 is protruding from the anvil head 66 and slides into the receiving groove 68 (not shown) of the anvil ring 22 (not shown) to lock into place prior to operation. The anvil 38 is symmetrical to allow a worn anvil to be inverted thus reversing the wear pattern on the anvil face 52 and prolong longevity of the anvil 38. Anvil 38 has a front surface 52, a rear surface opposite thereto, a top surface, a bottom surface, and a pair of side surfaces, with front surface and rear surface being wider than the side surfaces being rectangular shaped. The means for anchoring 64 is a male-like protruding attachment member located on the back surface of the anvil 38, the male-like members 64 having mating female members 68 on the anvil ring 22.

What is claimed is:

1. An apparatus for crushing stone, comprising:

a) an inlet for the uncrushed stone through which said inlet the uncrushed stone falls by gravity;

b) an outlet for the crushed stone through which said outlet the crushed stone falls by gravity;

c) a centrifugating head, said head centrifugating in a generally horizontal plane, said head disposed beneath said inlet, said head having means for receiving stone therein, said head disposed above said outlet, said head having means for expelling stone therefrom;

d) a plurality of anvils encircling said centrifugating head;

e) an anvil ring for receiving said plurality of anvils in a spaced apart relationship, said anvil ring disposed so as to place said plurality of anvils in position to receive stone expelled from said centrifugating head;

f) means for rotating said centrifugating head in generally horizontal plane;

g) an outer drum for partially enclosing said anvil ring and said centrifugating head;

h) a generally upstanding base upon which the apparatus is mounted;

i) a first means for mounting said anvil ring onto said base and including means for adjusting height of said anvil ring whereby said height adjustment occurs while the apparatus is operating; and, j) a second means for mounting said drum onto said base.

2. The apparatus of claim 1, said plurality of anvils being substantially rectangular in shape having a means for anchoring to said anvil ring.

3. The apparatus of claim 2, each said anvil defined by a front surface, a rear surface, a top surface, a bottom surface, and a pair of side surfaces, said front surface and said rear surface being wider than said side surfaces, said means for anchoring further comprising a male-like protruding attachment member on said rear surface of said anvil, said male-like members having mating female members on said anvil ring.

4. The apparatus of claim 3, wherein said anvils can be inverted whereby anvil life is extended.

5. The apparatus of claim 3, said anvil ring having a plurality of female-like members for receiving said mating male-like members of said anvils.

6. The apparatus of claim 5, wherein said anvils are positioned on said anvil ring so that said front surface of said anvils are substantially perpendicular to the line of travel of the stone expelled from said centrifugating head.

7. The apparatus of claim 5, said anvils being about 20 in number.

8. The apparatus of claim 1, said means for adjusting height of said anvil ring further comprising a plurality of rod-like lifts attached to the external peripheral surface of said anvil ring.

9. The apparatus of claim 8, further comprising said drum having a plurality of apertures therein, said apertures for receiving said rod-like lifts, said lifts thereby passing through said apertures of said drum.

10. The apparatus of claim 9, said first means for mounting said anvil ring onto said base further comprising said rod-like lifts.

11. The apparatus of claim 10, said first means for connecting said anvil ring onto said base further comprises multiple hydraulic support members communicating between said rod-like lifts and said base.

12. The apparatus of claim 1, said means for rotating said centrifugating head further comprising a pair of bevel gears, said bevel gears having a first shaft and a second shaft, said first and second shafts being generally perpendicular to each other, said first shaft connected to said centrifugating head, and said second shaft connected to a source of rotatable power.

13. The apparatus of claim 12, wherein said source of rotatable power is an internal combustion engine.

14. The apparatus of claim 1, said centrifugating head having means for receiving stone therein, said means for receiving stone further comprising a plurality of vertical wall means disposed on the upper surface of said centrifugating head, said walls collecting the stone from said inlet and being configured, whereby said walls expel the stone from said centrifugating head toward said anvils.

15. The apparatus of claim 1, wherein said means for adjusting height is done manually.

16. The apparatus of claim 1, wherein said means for adjusting height is done automatically.

* * * * *